US010208461B2

(12) United States Patent
Vicq et al.

(10) Patent No.: US 10,208,461 B2
(45) Date of Patent: Feb. 19, 2019

(54) WING SHROUD FOR AN EARTH MOVING MACHINE BUCKET, BUCKET AND EARTH MOVING MACHINE

(71) Applicant: Liebherr-Mining Equipment Colmar SAS, Colmar (FR)

(72) Inventors: Martial Vicq, Colmar (FR); Gerard Weber, Meyenheim (FR); Oliver Weiss, Ammerschwihr (FR)

(73) Assignee: Liebherr-Mining Equipment Colmar SAS, Colmar (FR)

( * ) Notice: Subject to any disclaimer, the term of this patent is extended or adjusted under 35 U.S.C. 154(b) by 783 days.

(21) Appl. No.: 14/030,383

(22) Filed: Sep. 18, 2013

(65) Prior Publication Data

US 2014/0082976 A1 Mar. 27, 2014

(30) Foreign Application Priority Data

Sep. 21, 2012 (EP) ..... 12006636

(51) Int. Cl.
*E02F 9/28* (2006.01)

(52) U.S. Cl.
CPC ..... *E02F 9/2883* (2013.01); *E02F 9/2825* (2013.01)

(58) Field of Classification Search
CPC ..... E02F 9/2883; E02F 9/2825; E02F 9/2833; E02F 9/28; E02F 9/2858; E02F 9/285; E02F 9/2816; E02F 9/2841; E02F 9/2808
USPC ..... 37/452–459
See application file for complete search history.

(56) References Cited

U.S. PATENT DOCUMENTS 2,896,345 A * 7/1959 Peklay ..... 37/453
3,171,500 A * 3/1965 Dils, Jr. ..... A01B 35/225 172/700
3,387,668 A * 6/1968 Mathers ..... A01B 15/025 172/700
3,704,753 A * 12/1972 Hasforth ..... E02F 9/2841 172/700
3,748,762 A * 7/1973 Tarrant ..... E02F 9/2808 172/751
3,812,608 A * 5/1974 Ratkowski ..... E02F 9/2858 37/448
3,851,413 A * 12/1974 Lukavich ..... E02F 9/2816 37/450
3,961,788 A * 6/1976 Helton ..... E02F 3/8152 172/701.2
3,999,614 A * 12/1976 Rhoads ..... E02F 9/2875 172/719

(Continued)

FOREIGN PATENT DOCUMENTS

DE 2052149 11/1971
FR 2574835 A1 6/1986

(Continued)

OTHER PUBLICATIONS

European Patent Office, Extended European Search Report of 12006636.0, Germany, dated Mar. 11, 2013, 6 pages.

*Primary Examiner* — Jessica H Lutz
(74) *Attorney, Agent, or Firm* — McCoy Russell LLP

(57) ABSTRACT

A wing shroud is provided for an earth moving machine bucket adapted to be positioned at least partially on a tooth adapter and/or at least partially on a lateral plate of the bucket for protecting wear sensitive bucket parts. The wing shroud includes at least one self-lock mechanism for a detachable connection to the bucket.

22 Claims, 3 Drawing Sheets

(56) References Cited

U.S. PATENT DOCUMENTS 4,129,934 A * 12/1978 Gettman ..... E02F 9/2841 29/426.2
4,182,057 A * 1/1980 Klett et al. ..... 37/448
4,204,349 A * 5/1980 Tallis ..... E02F 9/2808 172/777
4,233,761 A * 11/1980 Ryerson ..... 37/452
4,290,214 A * 9/1981 Stepe ..... E02F 9/2808 172/701.2
4,317,300 A * 3/1982 Emrich et al. ..... 37/453
4,326,348 A * 4/1982 Emrich ..... E02F 9/2841 172/719
4,404,760 A * 9/1983 Hahn ..... E02F 9/2825 37/459
4,414,764 A * 11/1983 Johansson ..... E02F 9/2841 37/450
4,428,131 A * 1/1984 Hahn ..... 37/453
4,716,667 A * 1/1988 Martin ..... E02F 9/2841 172/772
4,932,478 A * 6/1990 Jones ..... A01B 15/025 172/699
5,016,365 A * 5/1991 Robinson ..... E02F 3/40 37/451
5,075,986 A * 12/1991 Smith et al. ..... 37/457
5,088,214 A * 2/1992 Jones ..... E02F 9/2883 172/772.5
5,119,888 A * 6/1992 Hall ..... E02F 5/027 172/699
5,333,696 A * 8/1994 Cornelius ..... A01B 15/025 172/719
5,337,495 A * 8/1994 Pippins ..... E02F 9/2808 37/452
5,802,752 A * 9/1998 Quarfordt ..... E02F 9/2825 37/452
6,052,927 A * 4/2000 Pippins ..... E02F 9/2833 37/446
7,275,338 B2 * 10/2007 LaHood ..... E02F 9/2883 37/449
7,699,732 B2 * 4/2010 Message ..... F16H 7/1281 474/106
8,205,362 B2 * 6/2012 Yeomans ..... E02F 9/2825 172/699
8,770,311 B2 * 7/2014 Rivera ..... E02F 9/2875 172/699
D769,945 S * 10/2016 Serrurier ..... D15/28
D791,844 S * 7/2017 Kunz ..... D15/28
2002/0078607 A1 * 6/2002 Perry ..... E02F 3/8152 37/446
2003/0121185 A1 * 7/2003 Ollinger et al. ..... 37/457
2004/0237354 A1 * 12/2004 Emrich ..... E02F 9/2841 37/450
2006/0078373 A1 * 4/2006 Dingwall ..... E02F 9/2825 403/315
2013/0008062 A1 * 1/2013 Guimaraes ..... E02F 9/2833 37/446
2014/0325881 A1 * 11/2014 Plouzek ..... E02F 9/2883 37/455
2015/0101220 A1 * 4/2015 Renski ..... E02F 9/2808 37/455
2016/0305097 A1 * 10/2016 Kunz ..... E02F 9/2833
2016/0305098 A1 * 10/2016 Kunz ..... E02F 9/2883
2018/0023272 A1 * 1/2018 Kunz ..... E02F 9/2883

FOREIGN PATENT DOCUMENTS

WO 2007016719 A1 2/2007
WO 2011075782 A1 6/2011

* cited by examiner

WING SHROUD FOR AN EARTH MOVING MACHINE BUCKET, BUCKET AND EARTH MOVING MACHINE

CROSS REFERENCE TO RELATED APPLICATION

This application claims priority to European Patent Application No. 12 006 636.0, entitled "Wing Shroud for an Earth Moving Machine Bucket, Bucket and Earth Moving Machine," filed on Sep. 21, 2012, which is hereby incorporated by reference in its entirety for all purposes.

TECHNICAL FIELD

The present disclosure is related to a wing shroud for protecting wear sensitive parts of an earth moving machine bucket.

BACKGROUND AND SUMMARY

Shrouds are installed at different parts of a bucket for protecting defined bucket parts from abrasive wear. The installation of shrouds can prolong the bucket life since it will be sufficient to replace the outworn shrouds instead of purchasing a new bucket.

Currently, different kinds of shrouds are in use. For example, lip shrouds are placed on the leading edge of the bucket to protect the sensitive bucket edge parts which are strongly stressed during excavator work. Shrouds located at the bucket corner are called wing shrouds which are mainly designed for protection of the bucket cheek plates.

There are several processes known from the state of the art for mounting said protection means to the respective bucket parts. It is common practice to connect the protection means by bonding or welding. A further example suggests a wing shroud which is locked with a pin on a bucket sidewall. Another embodiment suggests protecting the top of a tooth adapter on the basis of a wear cap. On top of the wear cap a separated wing shroud is placed for protection of the bucket sidewall. Consequently, at least two single parts are necessary to achieve a sufficient protection of corner tooth adapter and sideplates. Regularly, said protection parts are held with an additional fixing element, in particular a pin or an axis situated on the bucket sidewall.

Alternatively, the above mentioned protection can be fixed by welded stopper arranged at the bucket. However, it is always necessary to modify the bucket or the shroud by a welding process.

All aforementioned solutions have the same disadvantage that the fixing of the protection requires additional parts to maintain a sufficient connection between the protection and the bucket. Consequently, replacement of the protection is either impossible or rather complicated and time-consuming.

Therefore, it is an object of the present disclosure to provide a wing shroud for a bucket which can be easily fixed to a bucket without the need of extra equipment.

In accordance with the present disclosure, this object is initially solved by a wing shroud adapted to be positioned at least partially on a tooth adapter and/or at least partially on a lateral plate of the bucket for protecting wear sensitive bucket parts wherein the wing shroud comprises at least one self-lock mechanism for a detachable connection to the bucket. Advantageous aspects of the wing shroud in accordance with the present disclosure are provided in the sub claims following the main claim.

Accordingly, in one example, a wing shroud for an earth moving machine bucket, in particular a mining bucket, is adapted to be positioned at least partially on a tooth adapter and/or at least partially on the lateral plate of the bucket. In case of a corner tooth adapter connected to the bucket, in particular by a welding process, the inventive wear shroud protects the tooth adapter, the lateral plate of the bucket and the connection line, in particular the welding line between tooth adapter and bucket.

In case of a casted corner tooth adapter the tooth adapter comprises a vertical portion vertically extending from the top surface of the adapter. The vertical portion forms a part of the lateral plate of the bucket. The vertical portion is connected to the bucket, in particular by a welding process. The inventive wing shroud is adapted to protect the tooth adapter and the vertical portion of the tooth adapter and optionally the lateral plate of the bucket.

This offers a sufficient protection for the most wear sensitive bucket parts. Protection of at least one bucket tooth adapter and at least one lateral plate of the bucket and/or the vertical portion of the tooth adapter is achieved by one single shroud. The inventive shroud combines the protection function of a known wear cap and a wing shroud.

The wing shroud further comprises at least one self-lock mechanism for a detachable connection to the bucket. Therefore, the inventive wing shroud is maintained without any additional parts, as for example a pin, an axis, or with help of any welded parts at the bucket and/or tooth adapter. During connecting process a self-lock occurs between the wing shroud and the bucket and/or the tooth adapter which does not require any welded part at the bucket or at the wing shroud. Further, a very easy and comfortable way of replacing said wing shroud is possible. Especially, the present disclosure offers a hammerless installation and disassembly of the wing shroud after abrasive wear occurred.

In an example aspect of the present disclosure, the wing shroud is adapted to protect at least one tooth adapter, in particular, a corner tooth adapter or a casted corner tooth adapter, at least one lateral plate of the bucket and/or a vertical portion of the tooth adapter and/or the welding line between the tooth adapter and the lateral plate. Consequently, three or more wear sensitive parts of a bucket can be easily protected with only a single part, namely the inventive wing shroud.

In accordance with another advantageous aspect of the present disclosure at least one self-lock mechanism assures a form-lock between the shroud and the bucket.

It might be sufficient that the wing shroud comprises at least one self-lock mechanism for a detachable connection to the tooth adapter. Additionally or alternatively, the wing shroud may comprise a self-lock mechanism for a detachable connection to the lateral plate of the bucket or to the vertical portion of the tooth adapter. In a particular aspect of the present disclosure, the wing comprises at least one self-lock mechanism for a detachable connection to the tooth adapter and at least another separated self-lock mechanism for a detachable connection to the lateral plate.

The wing shroud and the bucket may be closely linked to each other by mechanically locking them together. For example the locking mechanism comprises at least one plug formed on an inner surface of the wing shroud. The formed plug is adapted to engage into a groove arranged at the bucket or the tooth adapter. Said plug may snap into the respective groove. Alternatively, at least one plug may be slid into the respective groove from a predefined direction.

If at least one plug is engaged with at least one groove a movement of the wing shroud will be blocked, in particular a vertical and/or horizontal movement of the wing shroud will be blocked.

According to an aspect of the present disclosure, at least one plug is substantially wedge shaped. The plug may also be formed with one straight longitudinal side and one angular longitudinal side.

In an aspect of the present disclosure the wing shroud comprises an u-shaped cap member which is adapted to be arranged on top of at least one tooth adapter. The u-shaped cap member can partly embrace at least one tooth adapter to provide a sufficient protection of the covered tooth adapter part. In that case, at least one plug may be formed on an inner surface of the u-shaped cap member. In particular at least one plug extends horizontally along the inner surface of the cap member in parallel to the center line of the cap member. Especially, at least two plugs are arranged on opposite inner surfaces of the cap member.

According to another advantageous aspect of the present disclosure the wing shroud comprises a rising u-shaped neck member which extends from a base member, in particular from the u-shaped cap member of the shroud. The u-shaped neck member may be adapted to be arranged on the vertical front edge of the lateral plate of the bucket and/or the vertical front edge of the vertical portion of the tooth adapter when connecting the shroud to the bucket. In particular, the u-shaped neck member is adapted to partly embrace the lateral plate and/or vertical portion.

The present disclosure is further directed to a bucket for an earth moving machine comprising at least one wing shroud according to the present disclosure or according to any of the advantageous aspects of the present disclosure. Obviously, the bucket offers the same characteristics and benefits as the above mentioned wing shroud.

In an example aspect of the present disclosure, a horizontal movement of the wing shroud which is connected to the bucket is prevented by at least one tooth connected to a tooth adapter. In that case, at least one wing shroud may be detachable connected to the bucket on the basis of at least one locking mechanism. In particular, the wing shroud is connected to the bucket by at least one plug engaging in a respective groove of the bucket and by blocking a horizontal movement of the wing shroud by a tooth connected to the protected tooth adapter.

Further, the present disclosure is directed to an earth moving machine, in particular a mining machine, having at least one bucket according to the present disclosure.

Further details and advantages of the present disclosure will be explained in detail with reference to an embodiment illustrated in the drawings.

BRIEF DESCRIPTION OF THE FIGURES

FIGS. 1-6 are drawn to scale, although other dimensions may be used.

DETAILED DESCRIPTION

Figure 1:
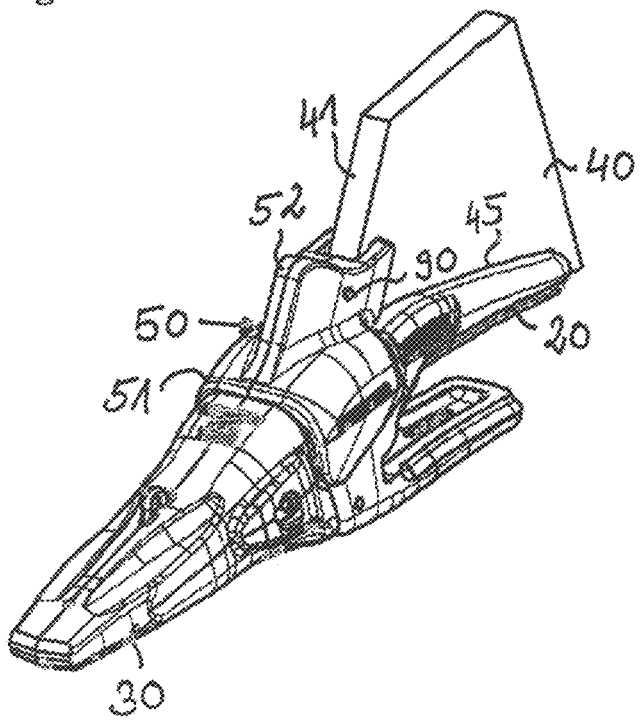
FIG. 1 shows a single connected bucket tooth of the inventive bucket in a perspective view.
Figure 2:
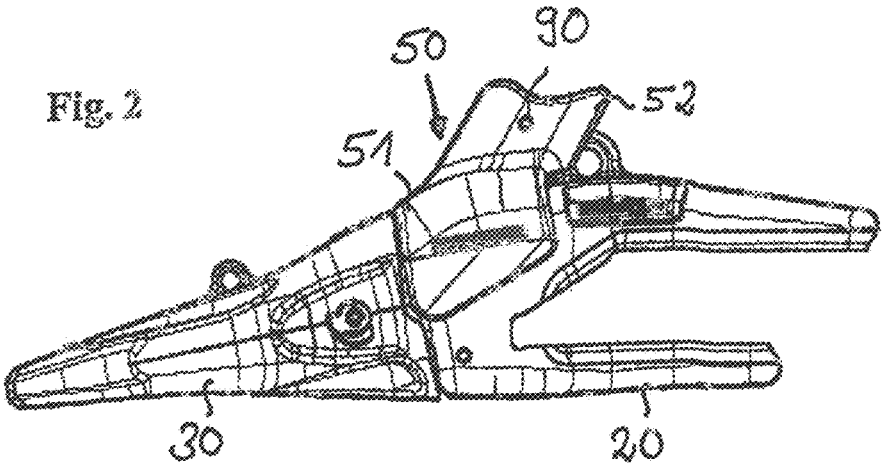
FIG. 2 shows the bucket tooth according to FIG. 1 in a side view.

FIG. 1 shows a perspective front view of one bucket tooth assembly of the inventive bucket. The depicted assembly includes a corner tooth adapter 20 which is arranged at one of the outer edges of the bucket. The tooth adapter 20 is connected to a lateral plate of the bucket denoted as bucket side wall 40 by a connection line 45, in particular a welding line 45. However, other connection options than a welding line are possible. A suitable bucket tooth 30 can be attached to the tooth adapter 20 forming the tooth assembly.

Figure 5:
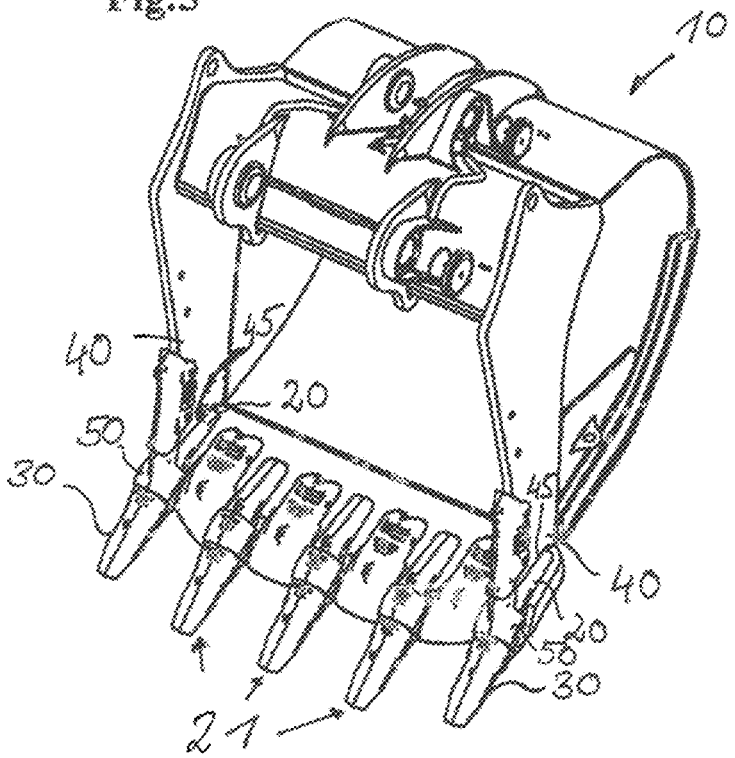
FIG. 5 shows a perspective view of the inventive bucket for an earth moving machine.

A complete exposition of the inventive bucket 10 can be seen in FIG. 5. The bucket 10 comprises two corner tooth adapters 20 arranged at booth outer edges of the bucket 10 and three regular tooth adapters 21 arranged between booth corner tooth adapters 20.

To protect the top of the corner tooth adapter 20, the lateral bucket plate 40 as well as the welding line 45 between the corner adapter 20 and the bucket plate 40 a wing shroud 50 according to the present disclosure is placed on a sub area of the top surface of the adapter 20 and a sub area of the sidewall 40. In one example, the wing shroud 50, which is a separate component from each of the adaptor 20, tooth 30, and plate 40, has face-sharing contact only on a sub area of the top surface of the adapter 20 and only on a sub area of the sidewall 40, as shown, while the sidewall 40 is also coupled to the adaptor 20 directly via the weld line 45. Further, the wing shroud 50 also partly covers the welding line 45 between the sidewall 40 and the adapter 20.

As can be seen from FIG. 1 the wing shroud 50 consists of a u-shaped cap member 51 and a rising u-shaped neck member 52 extending from the cap member 51. The cap member 51 has a horizontally extending opening 53 (FIG. 3*a*, 3*b*) in which the top surface of the tooth adapter 20 can be received. Similar to the cap member 51 the neck member 52 also comprises an opening 54 extending approximately in a vertically direction from the cap member 51 to the top of the wing shroud 50, for example, reasonably close to vertical. The opening 54 of the neck member 52 is adapted to receive the front edge 41 of the bucket side wall 40.

The present disclosure offers the possibility to protect the whole area where high wear occurs only with one single part, namely the inventive wing shroud 50. The lower wing shroud 50 protects the adapter 20, the welding line 45 and the bucket sidewall 40.

The wing shroud 50 is mounted without any additional parts as for example a pin or an axis. A self-lock occurs on one side with the bucket tooth adapter 20 and on the other side with the bucket sidewall 40. Especially, there is no need of a welded part to maintain or fix the wing shroud 50. In one example, a self-lock mechanism can be defined as creating a self-locking connection via interfacing surfaces that tend to further engage with surfaces or edges of the connecting component responsive to forces pulling the parts away from one another.

Figure 3A:
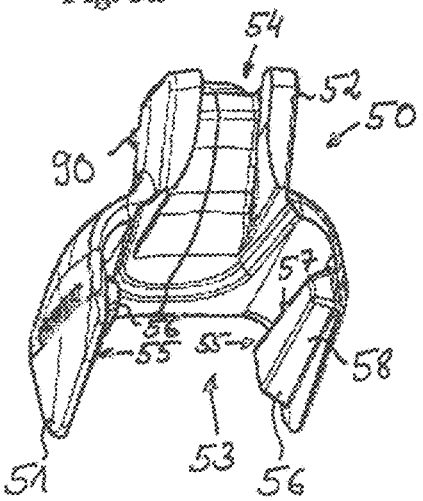
FIGS. 3*a* and 3*b* each show perspective views of the inventive wing shroud.
Figure 3B:
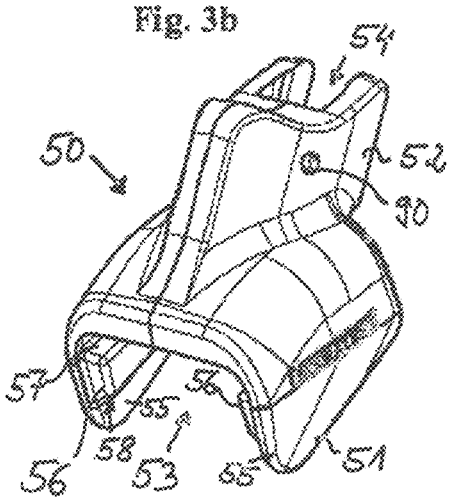

The principle of an example self-lock mechanism will be discussed with respect to FIGS. 3*a*, 3*b*. FIG. 3*a* shows a perspective rear view of the wing shroud 50 wherein FIG. 3*b* depicts a perspective front view of the wing shroud 50. As can be seen in FIG. 3*a* on each sidewall 55 of the cap member 51 a plug 56 is arranged on the inner surface of sidewalls 55. Each plug 56 has a wedge shape with a straight longitudinal side 57 and an angular longitudinal side 58. The shape may be substantially wedge-shaped, meaning approximately wedge-shaped with side 57 being reasonably close to straight and side 58 being angularly positioned relative thereto. The angle may be selected to be great enough to generate a self-locking connection to resist movement to disengage the member placed therein.

Figure 4:
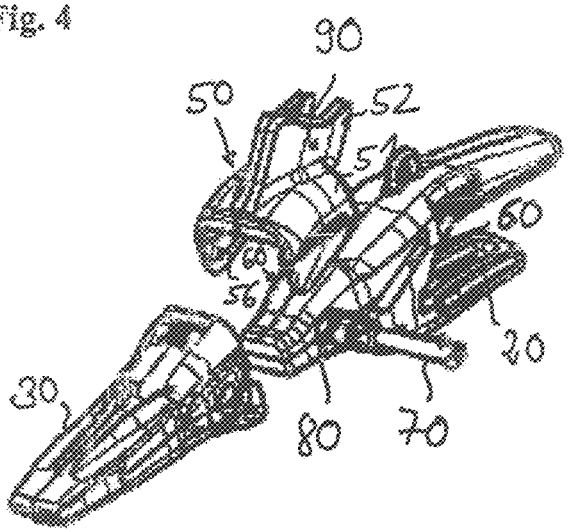
FIG. 4 shows an exploded view of the bucket tooth according to FIGS. 1 and 2.

The plugs 56 engage into respective grooves 60 (FIG. 4) on the sidewalls of the adapter 20 to fix the wing shroud 50 to the adapter 20 without any help of additional parts. With respect to FIG. 4 the grooves 60 are located at each sidewall of the adapter 20 wherein the form of each groove 60 is aligned to the general plug shape for receiving the respective plugs 56.

For installation of the wing shroud 50 onto the adapter 20 the shroud 50 is put on the distal end of the adapter 20 and shifted towards the bucket sidewall 40. Therefore, plugs 56 are shifted into the grooves 60 to provide a sufficient fixing on the top of the adapter 20.

Afterwards, the bucket tooth 30 is placed on the adapter 20 and bolted with the bolt 70. The bolt 70 is put into a bore 80 which extends through the complete adapter 20 across its center line. The edge of the tooth 30 facing the wing shroud 50 prevents a horizontal movement of the wing shroud 50. Because of the relative positioning of the two respective self-locking connections, and the corresponding shape and structure thereof, the wing shroud is thus fixed in position when engaged with both the wall 40 and adaptor 20.

Steal control point 90 is used during the manufacturing process to monitor the production quality.

The inventive wing shroud 50 is suitable for any bucket type for an earth moving machine. Especially, said wing shrouds 50 are offered for any ground engaging tools (G.E.T.) such as buckets for a mining machine.

Figure 6:
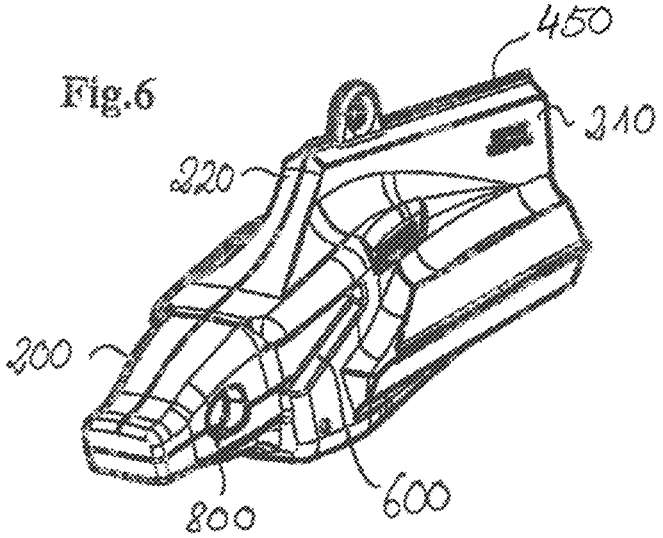
FIG. 6 shows a perspective view of a casted corner tooth adapter.

The inventive wing shroud also fits on different types of tooth adapters which differ from the adapter as described above. A casted corner tooth adapter 200 is shown in FIG. 6. The adapter 200 comprises a vertical portion 210 vertically extending from the top surface of the adapter 200 and forming a portion of the lateral plate of the bucket. The top edge of the vertical portion is connected along the line 450 to a bucket, in particular to the bucket sidewall. Usually the adapter 200 is connected to the bucket by a welding process forming the welding line 450.

The plugs 56 of the inventive wing shroud 50 also engage into the grooves 600 on the sidewalls of the adapter 200 to fix the wing shroud 50 to the adapter 200 without any help of additional parts. The grooves 600 are located at each sidewall of the adapter 200 wherein the form of each groove 600 is aligned to the general plug shape for receiving the respective plugs 56. The opening 54 of the wing shroud 50 neck member 52 is adapted to receive the front edge 220 of the vertical portion 210 of the adapter 200. It is also possible that the neck member 52 receives a small part of the front edge 41 of the bucket sidewall 40.

A tooth 30 can be placed on the adapter 200 and bolted with a bolt 70. The bolt 70 is put into the bore 800 which extends through the complete adapter 200 across its center line.

In one example, the self-lock mechanism described herein is structured with a form-fitting connection between the wing shroud and the bucket. For example, the self-lock mechanism may include structure that fits snugly around the external shapes of the wing shroud and/or the bucket. For example, the snug fit may provide for physical contact at various regions in order to create interference from movement in a plurality of orthogonal directions.

The invention claimed is:

1. A wing shroud for a bucket adapted to be positioned at least partially on a tooth adapter and at least partially on a lateral plate of the bucket for protecting wear sensitive bucket parts, wherein the wing shroud comprises at least one self-lock mechanism for a detachable connection to the bucket, wherein the self-lock mechanism comprises at least two plugs formed on an inner surface of the wing shroud wherein one of the at least two plugs is adapted to engage into a groove arranged at the tooth adapter; and wherein the self-lock mechanism maintains the wing shroud on the bucket by the at least two plugs without any additional parts.

2. The wing shroud according to claim 1, wherein the at least one self-lock mechanism is structured with a form-fit connection between the wing shroud and the bucket.

3. The wing shroud according to claim 1, wherein the wing shroud comprises another self-lock mechanism with a detachable connection to the lateral plate of the bucket.

4. The wing shroud according to claim 1, wherein the at least two plugs are approximately wedge shaped extending horizontally along the inner surface of the wing shroud.

5. The wing shroud according to claim 4, wherein the wing shroud comprises a u-shaped cap member adapted to be positioned on top of the tooth adapter.

6. The wing shroud according to claim 5, wherein the wing shroud comprises a rising u-shaped neck member extending from a base member, including the u-shaped cap member, and wherein the u-shaped neck member is adapted to be positioned on a vertical front edge of the lateral plate of the bucket or on a vertical portion of the tooth adapter.

7. The wing shroud according to claim 6, wherein the wing shroud is detachably connected to the bucket or tooth adapter without any additional parts, and wherein the u-shaped cap member is adapted to partly embrace the tooth adapter.

8. The wing shroud according to claim 1, wherein the wing shroud is adapted to protect at least one tooth adapter.

9. The wing shroud according to claim 1, wherein the wing shroud is adapted to protect a corner tooth adapter.

10. The wing shroud according to claim 1, wherein the wing shroud is adapted to protect at least one lateral plate of the bucket, a vertical portion of the tooth adapter, or a welding line between the tooth adapter and the lateral plate.

11. The wing shroud according to claim 1, wherein the wing shroud is adapted to be positioned at least partially on the tooth adapter and at least partially on the lateral plate of the bucket for protecting the wear sensitive bucket parts.

12. The wing shroud according to claim 1, wherein the wing shroud is adapted to be coupled to the bucket of an earth moving machine.

13. The wing shroud according to claim 12, wherein the wing shroud is adapted such that a horizontal movement of the wing shroud is prevented by one of the at least two plugs engaging in a respective groove of the tooth adapter and at least one tooth connected to the protected tooth adapter in face sharing contact with a front face of the wing shroud.

14. The wing shroud of claim 1, wherein the wing shroud is held in position without a pin, at the bucket and at the tooth adapter, and wherein an axis of the wing shroud is not situated on a bucket side wall.

15. A system, comprising:

an earthmoving bucket having a side wall;

a tooth;

a tooth adaptor coupled to the tooth; and a wing shroud including a pair of self-locking u-shaped regions positioned with a first opening directly engaging a top of the tooth adaptor and a second opening directly engaging the side wall, the wing shroud held in place without any additional parts.

16. The system of claim 15, wherein the side wall is an outer side wall of the bucket, the bucket further having bottom and top walls connected by the side wall, the tooth positioned at a bottom corner of the bucket, a neck of one of the u-shaped regions engaging the side wall facing forward in a direction of an opening of the bucket, the opening formed by the top, bottom, and side walls.

17. The system of claim 16, wherein the other of the u-shaped regions includes a pair of wedges to form a self-locking interface.

18. The system of claim 16, wherein the neck is angled backward.

19. The system of claim 18, wherein the side wall is welded to the tooth adaptor, the weld at least partially covered by the wing shroud.

20. The system of claim 19, wherein the tooth is bolted to the tooth adaptor.

21. The system of claim 15, wherein the wing shroud comprises a u-shaped base, an arched upper portion of the u-shaped base that is bridged across two vertical shroud sidewall portions of the u-shaped base which covers the tooth adaptor of a corner tooth of the bucket such that inner surfaces of the arched upper portion and the two vertical shroud sidewall portions of the u-shaped base are in face sharing contact with the tooth adaptor over a welding line of the tooth adaptor, the inner surface of the arched upper portion in face sharing contact with a top outer face of the tooth adaptor and the inner surfaces of the vertical shroud sidewall portions in face sharing contact with side outer faces of the tooth adaptor, the inner surfaces of the vertical shroud sidewall portions of the u-shaped base each having a wedge shaped plug, horizontal to a plane of the vertical shroud sidewall portions, which engage grooves of the tooth adaptor so as to lock the wing shroud onto the tooth adaptor, a front face of the u-shaped base abutting the tooth and a rear face of the u-shaped base abutting the tooth adaptor at a lateral plate of the bucket, and a u-shaped neck extending vertically and perpendicularly from the u-shaped base such that an outer front surface of the u-shaped neck joins the front face of the u-shaped base and two neck sidewall portions of the u-shaped neck project toward the rear face of the u-shaped base, inner surfaces of the u-shaped neck in face sharing contact with a front face of the lateral plate of the bucket such that an inner surface of the front face of the u-shaped neck is in face sharing contact with the front face of the lateral plate and the inner surfaces of the two neck sidewall portions of the u-shaped neck are in face sharing contact with sides of the front face of the lateral plate of the bucket.

22. The system of claim 15, wherein the wing shroud is held in position without a pin, at the bucket and at the tooth adaptor, and wherein an axis of the wing shroud is not situated on the bucket side wall.

* * * * *